US010065834B2

(12) United States Patent
Ratia et al.

(10) Patent No.: US 10,065,834 B2
(45) Date of Patent: Sep. 4, 2018

(54) ELEVATOR ARRANGEMENT AND METHOD

(71) Applicants: Jouni Ratia, Hyvinkaa (FI); Jussi Perälä, Hyvinkaa (FI)

(72) Inventors: Jouni Ratia, Hyvinkaa (FI); Jussi Perälä, Hyvinkaa (FI)

(73) Assignee: Kone Corporation, Helsinki (FI)

( * ) Notice: Subject to any disclaimer, the term of this patent is extended or adjusted under 35 U.S.C. 154(b) by 224 days.

(21) Appl. No.: 14/518,397

(22) Filed: Oct. 20, 2014

(65) Prior Publication Data

US 2015/0034425 A1 Feb. 5, 2015

Related U.S. Application Data

(63) Continuation of application No. PCT/FI2013/050445, filed on Apr. 22, 2013.

(30) Foreign Application Priority Data

May 23, 2012 (FI) ..... 20125548

(51) Int. Cl.
*B66B 9/00* (2006.01)
*B66B 7/06* (2006.01)
(Continued)

(52) U.S. Cl.
CPC ..... *B66B 9/00* (2013.01); *B66B 7/06* (2013.01); *B66B 11/008* (2013.01);
(Continued)

(58) Field of Classification Search
CPC ... B66B 11/00; B66B 11/008; B66B 11/0095; B66B 9/00; B66B 9/187; B66B 7/06; B66B 19/00; B66B 19/02
(Continued)

(56) References Cited

U.S. PATENT DOCUMENTS 3,101,130 A * 8/1963 Bianca ..... B66B 11/08 187/244
3,851,736 A * 12/1974 Westlake ..... B66B 19/002 29/429
(Continued)

FOREIGN PATENT DOCUMENTS

FI 20070994 A 6/2009
FI 20090512 * 12/2009
(Continued)

OTHER PUBLICATIONS

International Search Report PCT/ISA/210 for International Application No. PCT/FI2013/050445 dated Sep. 18, 2013.
(Continued)

*Primary Examiner* — Michael A Riegelman
(74) *Attorney, Agent, or Firm* — Harness, Dickey & Pierce, P.L.C.

(57) ABSTRACT

The invention relates to an elevator arrangement, which comprises one or more elevator units to be moved in an elevator hoistway, said unit(s) including at least an elevator car, and possibly also a counterweight, roping connected to an elevator unit, which roping comprises a plurality of ropes, and a moveable supporting structure in the elevator hoistway for supporting the aforementioned one or more elevator units below it via the aforementioned roping, and a rope pulley or rope pulley stack of the supporting structure in connection with the supporting structure, around which rope pulley or rope pulley stack the aforementioned roping travels, and from which the roping travels down to an elevator unit. The roping travels from the aforementioned rope pulley or rope pulley stack down to an elevator unit, in connection with which is a first rope pulley or rope pulley stack and a second rope pulley or rope pulley stack, which are disposed non-coaxially in relation to each other, their rotation axes being separate from each other in the lateral direction, and
(Continued)

in that the first part of the ropes of the roping traveling from the rope pulley or rope pulley stack down to the elevator unit travels to the elevator unit, to the first rope pulley or rope pulley stack that is in connection with the elevator unit, under the pulley or stack, and onwards back up to a rope anchorage arrangement, and the second part to the second rope pulley or rope pulley stack in that is connection with the elevator unit in question, under the pulley or stack, and onwards back up to a rope anchorage arrangement. The invention also relates to corresponding guidance of compensating roping, as well as to a method wherein the service range of the elevator car is increased.

14 Claims, 3 Drawing Sheets

(51) Int. Cl.
*B66B 19/02* (2006.01)
*B66B 11/00* (2006.01)
*B66B 19/00* (2006.01)

(52) U.S. Cl.
CPC ..... *B66B 11/0095* (2013.01); *B66B 19/00* (2013.01); *B66B 19/02* (2013.01)

(58) Field of Classification Search
USPC ..... 187/414
See application file for complete search history.

(56) References Cited

U.S. PATENT DOCUMENTS 5,000,292 A * 3/1991 Chapelain ..... B66B 19/002 187/408
6,471,012 B2 * 10/2002 Faletto ..... B66B 11/008 187/256
6,598,707 B2 * 7/2003 Nakagaki ..... B66B 11/008 187/254
7,156,209 B2 * 1/2007 Koeppe, Jr. ..... B66B 11/008 187/250
7,293,631 B2 * 11/2007 Ishii ..... B66B 11/008 187/250
7,549,514 B2 * 6/2009 Heggli ..... B66B 7/021 187/256
9,321,612 B2 * 4/2016 Fargo ..... B66B 11/008
9,371,212 B2 * 6/2016 Yapar ..... B66B 11/008
9,487,378 B2 * 11/2016 Lin ..... B66B 11/08
2004/0108170 A1 * 6/2004 Kocher ..... B66B 7/021 187/254
2008/0121468 A1 * 5/2008 Fischer ..... B66B 11/008 187/256
2009/0101448 A1 * 4/2009 Korkeakangas ..... B66B 19/02 187/261
2009/0114487 A1 * 5/2009 Bjorni ..... B66B 19/02 187/412
2009/0127033 A1 * 5/2009 Korkeakangas ..... B66B 19/02 187/414
2010/0163347 A1 7/2010 Van Der Meijden et al.
2012/0085594 A1 * 4/2012 Wright ..... B66B 11/008 187/266
2012/0291395 A1 * 11/2012 Plathin ..... B66B 19/00 52/741.1

FOREIGN PATENT DOCUMENTS

JP H03256986 A 11/1991
WO WO-0050328 A2 8/2000
WO WO-2009034224 A1 3/2009
WO WO-2010100319 A1 9/2010
WO WO-2011048255 A1 4/2011

OTHER PUBLICATIONS

Finnish Search Report for Application No. FI20125548 dated Feb. 12, 2013.
Written Opinion of the International Searching Authority PCT/ISA/237 for International Application No. PCT/FI2013/050445 dated Sep. 18, 2013.

* cited by examiner

ELEVATOR ARRANGEMENT AND METHOD

This application is a continuation of PCT International Application No. PCT/FI2013/050445 which has an International filing date of Apr. 22, 2013, and which claims priority to Finnish patent application number 20125548 filed May 23, 2012, the entire contents of both which are incorporated herein by reference.

FIELD OF THE INVENTION

The object of the invention is an elevator arrangement and a method in the fabrication of an elevator, which elevator is preferably an elevator applicable to passenger transport and/or freight transport, and in which method and elevator arrangement the elevator is taken/can be taken into service use already during its construction time.

BACKGROUND OF THE INVENTION

In connection with so-called jump-lifts, an elevator is taken into use already before the full length of the elevator hoistway has been completed. The elevator car moving in the bottom part of the elevator hoistway is supported and moved during the construction-time use suspended on ropes that are supported by a supporting structure in the elevator hoistway, which ropes are moved directly or indirectly with a hoisting machine. The top part of the elevator hoistway above the supporting structure is constructed at the same time as an elevator car moving in the already completed bottom part of the elevator hoistway serves people on the lower floors of the building. The hoisting machine can be supported e.g. on the aforementioned supporting structure. When the part of the elevator hoistway under construction above the supporting platform has reached a sufficient stage of readiness, it can be taken into use. In this case a lift (a so-called jump-lift) is performed, wherein the supporting structure is raised to a higher position in the elevator hoistway, thus extending the service range of the elevator car upwards. A worksite crane in use in the construction of the building can, for example, be used for the lifting. Alternatively, the supporting structure could be shifted with a hoist, which is supported on a support structure to be arranged in the hoistway above the machine room platform. When the elevator hoistway has reached its final height, the elevator is left permanently in its position, possibly however first performing some conversion procedures, e.g. by removing the elements required for jump-lifts, possibly by replacing the roping and/or by changing its route. One solution according to prior art is described in publications WO 2010100319 A1 and WO 2011048255 A1.

For enabling jump-lifts, choices have had to be made in the placement of the supporting structure and of the ropes hanging supported by it, as well as in the placement of the components that are in connection with the supporting structure, which choices differ from the component placement of a conventional elevator. For example, enabling the movability of the supporting structure has required a support means system, which takes space to a degree that reduces the freedom of placement of the other components. Likewise, enabling an increase in the length of the ropes has had to be taken into account. Generally the ropes are led to a rope supply storage via an openable clamp that is in connection with the supporting structure. Generally, there has further been a need to form the layout in such a way that safe working on the supporting structure is made possible. In addition, it has been necessary to dispose a system of means in connection with the supporting structure for moving the supporting structure. Taking into account the many exceptional issues that must be addressed has hampered the locating of the center of mass of the supporting structure in the best possible spot from the viewpoint of a jump-lift. It has been noticed that the location of the center of mass during a jump-lift is of great importance to dividing the support forces of the supporting structure when the supporting structure is supported in its position in the hoistway. Likewise, the location of the center of mass during a jump-lift is of great importance to dividing the support forces of the supporting structure during the jump-lift. Problems have also been caused by, inter alia, the fact that if the center of mass is at a distance from the center point of the hoistway, the support forces of the hoisting arrangement must also be received in the same manner eccentrically, which can impede the finding of a support point, especially in solutions in which the hoisting arrangement rests on structures of the hoistway. The location of the center of mass also otherwise affects control of the lifting of the supporting structure. The location of the center of mass affects e.g. the susceptibility of the supporting structure to lurching by affecting the lever arm lengths of the forces acting on the edge areas of the supporting structure. One factor significantly affecting the location of the center of mass is the route traveled by the ropes and the location of the rope pulley diverting the roping that is in connection with the supporting structure, which rope pulley is generally a rope pulley of the hoisting machine. During the lifting of the supporting structure, the weight of the ropes hanging supported by the supporting structure is large, in which case the effect of them on the center of mass is also great. In addition, the self-weight of the rope pulley and of a machine possibly connected to it affect the center of mass. The placement of these heavyweight structures has been difficult to implement advantageously from the viewpoint of the center of mass, which has resulted in either an eccentric center of mass or in an otherwise complex structure. Problems relating to this have arisen in particular when the elevator units are supported with roping that travels via the rope pulleys of an elevator unit. Yet another problem has been that at the end of the fabrication process of an elevator, when the elevator is converted into the final elevator, the exceptional layout during the jump-lift has generally had to be drastically changed. For example, it has often been necessary to change the location of the aforementioned rope pulley of the supporting structure. More particularly, it has been necessary to change the location of the rope pulley when it has been desired to change the suspension of the final elevator car and/or counterweight from a 2:1 lifting ratio to a 1:1 lifting ratio. A corresponding problem has become evident when changing the suspension of the compensating ropes hanging suspended from the elevator car and the counterweight.

BRIEF DESCRIPTION OF THE INVENTION

An aim of the invention is to solve the aforementioned problems of prior-art solutions. A further aim is to solve the problems disclosed in the description of the invention below. The aim is thus to produce an improved construction-time elevator arrangement and an improved method in the fabrication of an elevator. Some embodiments, inter alia, are disclosed with which it is possible to influence more freely the position of the center of mass of a supporting structure. In this way better control of the lifting of the supporting structure is achieved. During the time when the supporting structure is stationary and during a lift, distribution of the support forces can be made to be more even than before. With the solution it is also possible to form a simpler layout of a jump-lift than earlier. For example, it is possible to form the layout of a jump-lift to be such that the diverting pulley of the supporting structure is not inclined with respect to the direction of the wall of the elevator car/elevator hoistway. Some embodiments, inter alia, are disclosed with which it is possible to change the suspension of the final elevator car and/or counterweight from a 2:1 lifting ratio to a 1:1 lifting ratio simply.

The elevator arrangement according to the invention comprises an elevator hoistway, one or more elevator units to be moved in the elevator hoistway, said unit(s) including at least an elevator car, and possibly also a counterweight, roping connected to an elevator unit, which roping comprises a plurality of ropes, a moveable supporting structure in the elevator hoistway for supporting the aforementioned one or more elevator units below it via the aforementioned roping, and a rope pulley or rope pulley stack of the supporting structure in connection with the supporting structure, around which rope pulley or rope pulley stack the aforementioned roping travels, and from which the roping travels down to an elevator unit. The roping travels from the aforementioned rope pulley or rope pulley stack of the supporting structure down to an elevator unit, in connection with which is a first rope pulley or rope pulley stack and a second rope pulley or rope pulley stack, which are disposed non-coaxially in relation to each other, their rotation axes being separate from each other in the lateral direction, and the first part of the ropes of the roping traveling from the aforementioned rope pulley or rope pulley stack of the supporting structure down to the elevator unit travels to the elevator unit, to the first rope pulley or rope pulley stack that is in connection with the elevator unit, under the pulley or stack, and onwards back up to a rope anchorage arrangement, and the second part to the second rope pulley or rope pulley stack that is in connection with the elevator unit in question, under the pulley or stack, and onwards back up to a rope anchorage arrangement. In this way, one or more of the aforementioned advantages are achieved. In this case, among other things, the roping can be led to travel from the rope pulley or rope pulley stack of the supporting structure to an elevator unit, closer to the center point of the elevator unit than before. In this way, also, the aforementioned rope pulley or rope pulley stack of the supporting structure can be disposed closer in the lateral direction to the center point of the supporting structure than before. Thus the later conversion of the suspension to a 1:1 lifting ratio also becomes easier.

In one preferred embodiment the elevator arrangement comprises elevator units to be moved in an elevator hoistway, said unit(s) including an elevator car and a counterweight, and the aforementioned roping connecting the aforementioned elevator car and aforementioned counterweight, and that the aforementioned roping on the first side of the rope pulley travels down to one of the aforementioned elevator units, and the roping on the second side of the rope pulley or rope pulley stack travels down to the other of the aforementioned elevator units, and that the roping on the first and/or second side of the rope pulley or rope pulley stack of the supporting structure travels down to an elevator unit, in connection with which is a first rope pulley or rope pulley stack and a second rope pulley or rope pulley stack, which are disposed non-coaxially in relation to each other, their rotation axes being separate from each other in the lateral direction, and that the first part of the ropes of the roping traveling from the rope pulley or rope pulley stack down to the elevator unit in question travels to the elevator unit, to the first rope pulley or rope pulley stack that is in connection with the elevator unit, under the pulley or stack, and onwards back up to a rope anchorage arrangement, and the second part to the second rope pulley or rope pulley stack that is in connection with the elevator unit in question, under the pulley or stack, and onwards back up to a rope anchorage arrangement. In this way the aforementioned advantages are achieved in connection with an elevator having a counterweight.

In one preferred embodiment the elevator arrangement comprises the aforementioned rope pulleys/rope pulley stacks that are fixed to the roof of the elevator car and are disposed non-coaxially in relation to each other, and/or the rope pulleys/rope pulley stacks that are fixed to the counterweight, to the top of it, and are disposed non-coaxially in relation to each other.

In one preferred embodiment the roping on the first side of the aforementioned rope pulley or rope pulley stack of the support structure travels down to an elevator unit in the manner defined above, which elevator unit is a counterweight, and the aforementioned rope anchorage arrangement, to which the roping back upwards from the first and from the second rope pulley or rope pulley stack travels, is openable, and the roping travels via it to the rope supply storage. In this way the roping can be simply, from the viewpoint of space usage, guided to the rope supply storage, because the counterweight is disposed at the edge of the hoistway and there are no elevator components (such as a machine) at the point of it that would be in the way of the ropes being guided to the storage.

In one preferred embodiment the roping travels up to an openable rope anchorage arrangement in a first half of the elevator hoistway, preferably on a first side of the elevator car, and the roping from the rope anchorage arrangement is guided to travel down to a rope supply storage in the second half of the elevator hoistway, preferably on the second side of the elevator car.

In this way the downward-pulling force exerted on the supporting structure by the roping can be evened out on the opposite sides of the supporting structure.

In one preferred embodiment the rope anchorage arrangement for fixing the parts of the roping that are on the first side of the aforementioned rope pulley and/or the rope anchorage arrangement for fixing the parts of the roping that are on the second side of the aforementioned rope pulley is in connection with the supporting structure or in the proximity of it.

In one preferred embodiment the roping travels from the supporting structure straight down to at least one or more of the aforementioned elevator units essentially at the center point of the vertical projection of the elevator unit, preferably the roping travels from the supporting structure straight down to each elevator unit essentially at the center point of the vertical projection of the elevator unit. Thus the centricity of the suspension is simple to arrange already during construction-time use, as well as after the conversion. More particularly, changing the suspension to a 1:1 suspension ratio is simple with only small modifications to the elevator structures.

In one preferred embodiment the elevator arrangement possesses one or more of the following features

- the axis of rotation of the aforementioned rope pulley or rope pulley stack is in the direction of the wall of the elevator car,
- the counterweight is arranged to travel on one side of the elevator car, and the axis of rotation of the aforementioned rope pulley or rope pulley stack of the supporting structure is in the direction of the elevator car wall that is on the side of the counterweight, the axis of rotation of the aforementioned rope pulley or rope pulley stack of the supporting structure is in the direction of the guide rail plane formed by the guide rails of the counterweight and/or the elevator car, the axis of rotation of the rope pulley of the supporting structure is in the direction of the wall of the elevator car.

A second elevator system according to the concept of the invention comprises an elevator hoistway, one or more elevator units to be moved in the elevator hoistway, said unit(s) including at least an elevator car, and possibly also a counterweight, and a moveable supporting structure in the elevator hoistway for supporting the aforementioned one or more elevator units below it, roping connected to the aforementioned one or more elevator units and hanging suspended from the aforementioned one or more elevator units, which roping comprises a plurality of ropes, a rope pulley or rope pulley stack supported to rotate below the aforementioned one or more elevator units, around which rope pulley or rope pulley stack the aforementioned roping travels, and from which the roping travels up to one or more elevator units. The roping travels from the rope pulley or rope pulley stack supported to rotate below the aforementioned one or more elevator units up to an elevator unit, in connection with which is a first rope pulley or rope pulley stack and a second rope pulley or rope pulley stack, which are disposed non-coaxially in relation to each other, their rotation axes being separate from each other in the lateral direction, and that the first part of the ropes of the roping traveling from the aforementioned rope pulley or rope pulley stack supported to rotate below the elevator unit up to the elevator unit travels to the elevator unit, to the first rope pulley or rope pulley stack that is in connection with the elevator unit, over the pulley or stack, and onwards back down to a rope anchorage arrangement, and the second part to the second rope pulley or rope pulley stack that is in connection with the elevator unit in question, over the pulley or stack, and onwards back down to a rope anchorage arrangement. In this way the concept of the invention can be applied to compensating roping. In this way advantages corresponding to those disclosed earlier in connection with suspension roping are achieved. More particularly the later conversion of the suspension ratio of the compensating rope to a 1:1 suspension is facilitated.

In any whatsoever of the preferred embodiments of an elevator arrangement described above the roping travels as a dense bundle from the rope pulley or rope pulley stack of the supporting structure to the first and second rope pulleys/rope pulley stacks of an elevator unit, which pulleys/stacks divide the first and second part of the roping to be conducted away from each other. In this way guiding the roping concentrically to the elevator unit becomes easier. Likewise, forming the suspension between an elevator unit and the roping symmetrically becomes easier.

In any whatsoever of the preferred embodiments of an elevator arrangement described above the aforementioned first and second rope pulleys/rope pulley stacks of an elevator unit are arranged to guide the first and the second part traveling close to each other from the rope pulley or rope pulley stack to the first and to the second rope pulleys/rope pulley stacks of the elevator unit to be conducted away from each other, in which case the first and the second part travel away (up or down) from the rope pulleys/rope pulley stacks of the elevator unit at a distance from each other. In this way guiding the roping concentrically to the elevator unit becomes easier. Likewise, forming the suspension between an elevator unit and the roping symmetrically becomes easier. Also in this way it is simple to configure the forces exerted on the supporting structure by the rope anchorage arrangements to be symmetrical, e.g. around a center line of the supporting structure.

In any whatsoever of the preferred embodiments of an elevator arrangement described above the roping travels via an openable rope anchorage arrangement to a rope supply storage, such as e.g. to a rope reel.

In any whatsoever of the preferred embodiments of an elevator arrangement described above the roping on the first side of the aforementioned rope pulley or rope pulley stack travels to an elevator unit, which is a counterweight, and on the second side to an elevator unit, which is an elevator car.

In any whatsoever of the preferred embodiments of an elevator arrangement described above the elevator arrangement comprises means for lifting the supporting structure upwards in the elevator hoistway, which means preferably comprise a movable support structure to be supported in the elevator hoistway for taking support from the hoistway or from a structure fixed to the hoistway. The centricity of the center of mass in connection with this type of hoisting arrangement is particularly advantageous, inter alia because the structures of the elevator hoistway supporting the hoisting means are thus evenly loaded. For example, if the hoisting means take the support force needed for lifting from the guide rails, the even loading prevents buckling of the guide rail lines.

In any whatsoever of the preferred embodiments of an elevator arrangement described above the aforementioned means for lifting the supporting structure upwards in the elevator hoistway are arranged to pull the supporting structure higher up in the elevator hoistway from above, preferably via a flexible member such as a rope, chain or belt.

In any whatsoever of the preferred embodiments of an elevator arrangement described above the first and the second part are guided to travel from the aforementioned rope pulley or rope pulley stack between the aforementioned first and second rope pulleys/rope pulley stacks. In this way the roping can be guided to the elevator unit as a dense bundle. More particularly, guiding the roping very concentrically to the elevator unit becomes possible.

In any whatsoever of the preferred embodiments of an elevator arrangement described above the axes of the aforementioned first and second rope pulley/rope pulley stacks that are disposed non-coaxially in relation to each other are parallel or are at an angle of at most 45 degrees with respect to each other. In this way guiding the roping concentrically, or at least rather concentrically, to the elevator unit becomes possible and the structure is compact.

In any whatsoever of the preferred embodiments of an elevator arrangement described above the axes of the aforementioned first and second rope pulleys/rope pulley stacks that are disposed non-coaxially in relation to each other are at essentially the same height as each other.

In any whatsoever of the preferred embodiments of the elevator arrangement described above, the supporting structure comprises means for the vertical support of the supporting structure in its position in the elevator hoistway, which means can be moved between a state supporting the supporting structure in its position in the vertical direction and a state not supporting it in its position in the vertical direction. In this way displacement of the supporting structure in jump-lifts becomes possible.

In the method according to the invention in the fabrication of an elevator, an elevator arrangement is formed, which is according to any of those described above, and in the method these phases are performed a) the elevator car is used to transport passengers and/or freight, after which
b) the supporting structure is lifted to a higher position in the elevator hoistway, after which
c) the elevator car is used to transport passengers and/or freight.

In one preferred embodiment in the method after phase b has been performed one or more times, e.g. when a phase cycle comprising the aforementioned phases a, b and c has been performed one or more times, the suspension of the aforementioned elevator unit/elevator units, in connection with which are the aforementioned non-coaxial first and second rope pulley/rope pulley stack, in such a way that the lifting ratio of the elevator unit or of both the elevator units in question is 1:1. In this way the elevator can be converted to possess simple roping that is better suited to the final elevator, e.g. to a high-rise elevator. A construction-time elevator can thus be converted into the final elevator.

In one preferred embodiment in the method after phase b has been performed one or more times, e.g. when a phase cycle comprising the aforementioned phases a, b and c has been performed one or more times, the suspension of the aforementioned elevator unit/elevator units is changed by replacing the roping with new roping.

In one preferred embodiment in the method rope for the lifting of phase b is released from the rope storage, to which the roping travels via an openable rope anchorage arrangement.

The elevator is most preferably an elevator applicable to the transporting of people and/or of freight, which elevator is installed in a building, inside the cross-section of the building, to travel in a vertical direction, or at least in an essentially vertical direction, preferably on the basis of landing calls and/or car calls. The elevator car preferably has an interior space, which is suited to receive a passenger or a number of passengers. The elevator preferably comprises at least two, preferably more, floor landings to be served. Some inventive embodiments are also presented in the descriptive section and in the drawings of the present application. The inventive content of the application can also be defined differently than in the claims presented below. The inventive content may also consist of several separate inventions, especially if the invention is considered in the light of expressions or implicit sub-tasks or from the point of view of advantages or categories of advantages achieved. In this case, some of the attributes contained in the claims below may be superfluous from the point of view of separate inventive concepts. The features of the various embodiments of the invention can be applied within the framework of the basic inventive concept in conjunction with other embodiments.

BRIEF DESCRIPTION OF THE FIGURES

The invention will now be described mainly in connection with its preferred embodiments, with reference to the attached drawings, wherein.

DETAILED DESCRIPTION OF THE INVENTION

Figure 1:
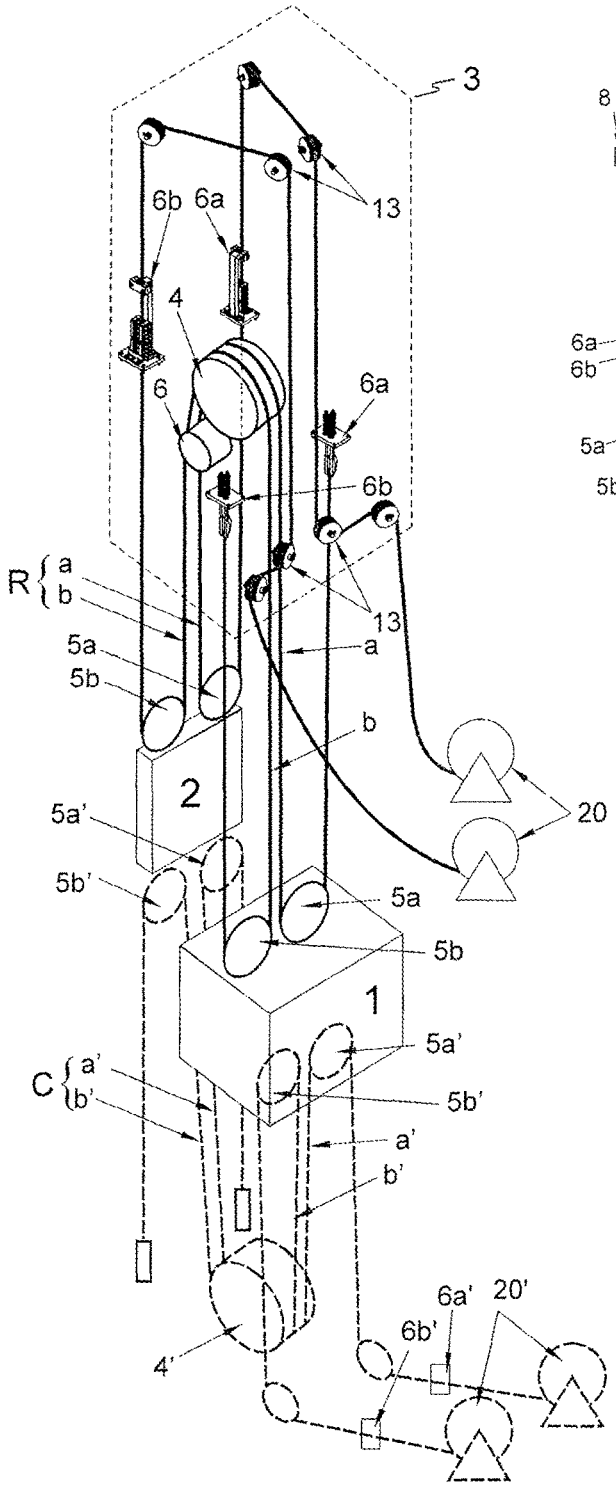
FIG. 1 presents a three-dimensional view of an elevator arrangement according to one embodiment.

FIG. 1 presents an elevator arrangement according one embodiment, which elevator arrangement comprises an elevator hoistway S, and elevator units, an elevator car 1 and a counterweight 2, to be moved in the elevator hoistway S. The arrangement comprises roping R connecting the aforementioned elevator car 1 and aforementioned counterweight 2, which roping comprises a plurality of ropes, and also a moveable supporting structure 3 to be disposed in the elevator hoistway S for supporting the aforementioned elevator units 1 and 2 below it via the aforementioned roping R. A rope pulley or rope pulley stack 4 of the supporting structure is in connection with the supporting structure 3, which pulley or stack can therefore be an individual rope pulley or a rope pulley system of at least essentially co-axial rope pulleys assembled into a stack. The aforementioned rope pulley or rope pulley stack is preferably driven by a motor, in which case it forms a traction sheave. Traction can, of course, be arranged in other ways. The roping R travels around the aforementioned rope pulley or rope pulley stack 4 and travels from it down to the elevator units 1, 2 in such a way that the aforementioned roping R on the first side of the rope pulley or rope pulley stack 4 travels down to one of the aforementioned elevator units 1, 2, and the roping R on the second side of the rope pulley or rope pulley stack 4 travels down to the other of the aforementioned elevator units 1, 2. The roping hangs suspended from the aforementioned rope pulley or rope pulley stack 4. The roping R travels on both the first and the second side of the rope pulley 4 of the supporting structure down to an elevator unit 1, 2, in connection with which is a first rope pulley or rope pulley stack 5*a* and a second rope pulley or rope pulley stack 5*b*, which are disposed non-coaxially in relation to each other, their rotation axes $X_1$, $X_2$ being separate from each other in the lateral direction, and the first part a of the ropes of the roping R traveling from the rope pulley 4 down to the elevator unit 1, 2 in question travels to the elevator unit 1, 2, to the first rope pulley or rope pulley stack 5*a* that is in connection with the elevator unit 1, 2, under the pulley or stack, and onwards back up to a rope anchorage arrangement 6*a*, and the second part b to the second rope pulley or rope pulley stack 5*a* that is in connection with the elevator unit in question, under the pulley or stack, and onwards back up to a rope anchorage arrangement 6*b*. The parts a and b of the roping R thus travel via different rope pulleys/rope pulley stacks of an elevator unit. In this way both elevator units 1 and 2 are suspended with roping, which travels as a dense bundle from the rope pulley or rope pulley stack 4 of the supporting structure to the first and second rope pulleys/rope pulley stacks 5*a*, 5*b* of the elevator unit in question, which pulleys/stacks divide the first and second part a, b of the roping R to be conducted away from each other. In this way a concentric suspension can be achieved although the suspension is implemented via a diverting pulley. The roping R can in this way be guided to descend as a dense bundle down to each elevator unit essentially at the center point of its vertical projection. In this way also the aforementioned rope pulley or rope pulley stack 4 can be disposed at the point of the center part of the elevator unit/elevator units as viewed in the axial direction of the aforementioned rope pulley or rope pulley stack 4. Since the ropes descend to the elevator unit at least essentially the center point of its vertical projection, it is simple to later convert the 2:1 suspension implemented via the rope pulley into 1:1 suspension without the rope pulley. In this case the ropes can continue to descend along the same route to the elevator unit after the suspension conversion.

In the embodiment presented the aforementioned first and second rope pulleys/rope pulley stacks 5*a*, 5*b* are fixed to the elevator car 1, to the top of it (to the roof) and correspondingly the first and second rope pulleys/rope pulley stacks 5*a*, 5*b* of the counterweight 2 are fixed to the counterweight 2, to the top of it.

For enabling the supply of the additional rope needed for the jump-lift, the roping R travels on a first or on a second side of the aforementioned rope pulley or rope pulley stack 4 to a rope anchorage arrangement, which is openable, and the roping travels via it to the rope supply storage, from where the rope can be supplied without break into the elevator system. In the solution presented, this is implemented on the counterweight 2 side.

As is seen from FIG. 1, the roping R travels up to an openable rope anchorage arrangement 6*a*, 6*b* in a first half of the elevator hoistway, on a first side of the elevator car, and the roping R from the rope anchorage arrangement 6*a*, 6*b* is guided to travel down to a rope supply storage 20 in the second half of the elevator hoistway, on the second side of the elevator car. In this way the downward-pulling force exerted on the supporting structure by the roping R can be evened out on the opposite sides of the supporting structure, which reduces the resultant forces of the roping trying to rock supporting structure. Rope pulleys 13 that are in connection with the supporting structure can be used for guiding the roping from the rope anchorage arrangement 6*a*, 6*b*.

The elevator units preferably travel on guide rails (not presented). There are preferably two guide rails per each elevator unit and the guide rail plane determined by the guide rail pair of the counterweight is preferably in the same direction as the wide side of the counterweight and the guide rail plane determined by the guide rail pair of the elevator car is preferably in the same direction as the wall of the elevator car, in FIG. 1 the elevator car wall on the counterweight side. The axis of rotation of the rope pulley or rope pulley stack 4 of the supporting structure is preferably in the direction of the guide rail plane determined by the guide rails of the counterweight and/or the guide rail plane determined by the elevator car.

Described above are the passage of the roping suspending the elevator units and also the operation and placement of the first and of the second rope pulleys/rope pulley stacks. The compensating roping of an elevator can, however, be arranged in a corresponding manner, in which case the difference to what has been described earlier is that the rope arrangement, i.e. the roping and the rope pulleys guiding the roping, are upside-down, acting below the elevator units. In this case the elevator arrangement comprises an elevator hoistway S, one or more elevator units 1, 2 to be moved in the elevator hoistway S, said unit(s) including at least an elevator car 1, and possibly also a counterweight 2, a moveable supporting structure 3 in the elevator hoistway S for supporting the one or more elevator units 1, 2 below it, and roping C connected to the aforementioned one or more elevator units 1, 2 and hanging suspended from the aforementioned one or more elevator units 1, 2, which roping comprises a plurality of ropes, and a rope pulley or rope pulley stack 4' supported to rotate below the aforementioned one or more elevator units 1, 2, around which rope pulley or rope pulley stack the aforementioned roping C travels, and from which the roping C travels up to an elevator unit 1, 2. The roping C travels from the rope pulley or rope pulley stack 4' up to an elevator unit 1, 2, in connection with which is a first rope pulley or rope pulley stack 5*a*' and a second rope pulley or rope pulley stack 5*b*', which are disposed non-coaxially in relation to each other, their rotation axes X1, X2 being separate from each other in the lateral direction, and in that the first part a' of the ropes of the roping C traveling from the aforementioned rope pulley or rope pulley stack 4' up to the elevator unit 1, 2 travels to the elevator unit 1, 2, to the first rope pulley or rope pulley stack 5*a*' that is in connection with the elevator unit 1, 2, over the pulley or stack, and onwards back down to a rope anchorage arrangement 6*a*', and the second part b' to the second rope pulley or rope pulley stack 5*a*' that is in connection with the elevator unit in question, over the pulley or stack, and onwards back down to a rope anchorage arrangement 6*b'*.

Figure 2:
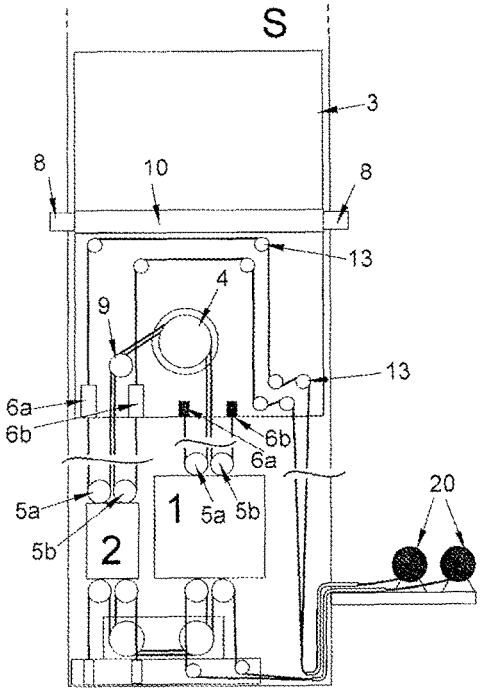
FIG. 2 presents by way of reference the elevator arrangement according to FIG. 1.

FIG. 2 presents the elevator of FIG. 1 by way of reference to illustrate the routes of the ropings R, C. The first and the second rope pulleys 5*a*, 5*b*; 5*a*', 5*b*', the counterweight is presented in the figure turned sideways for clarifying presentation of the lifting principle.

Figure 3:
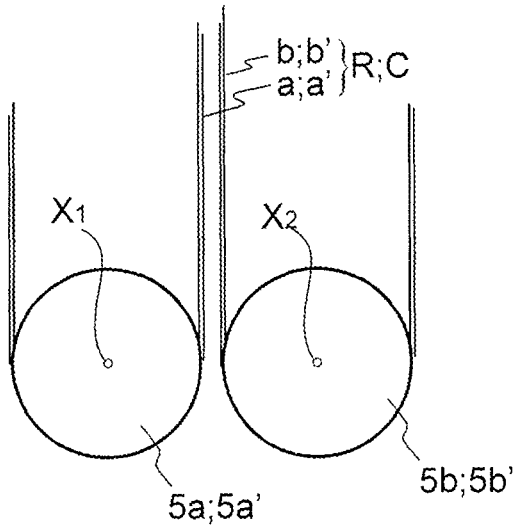
FIG. 3 presents a side view of how the roping arrives at a first and a second rope pulley or rope pulley stack.
Figure 4:
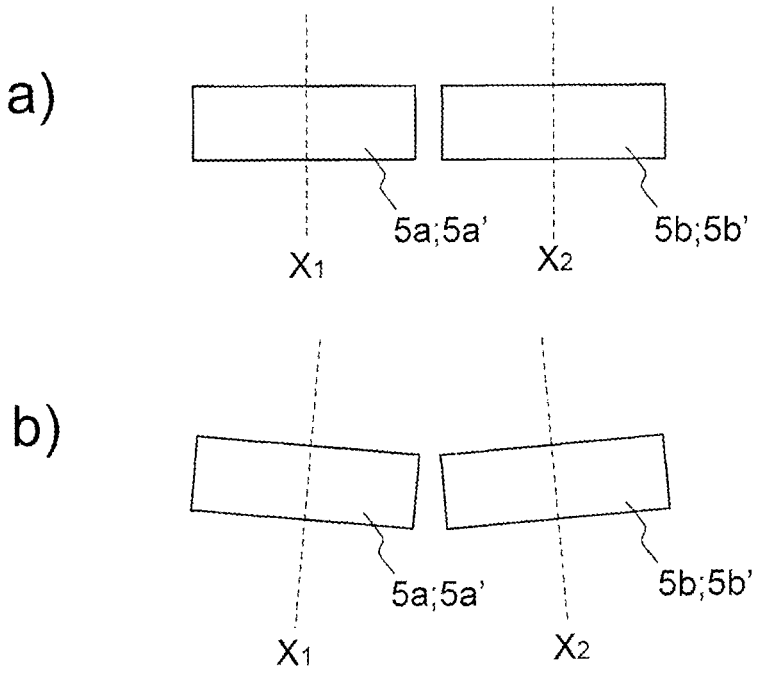
FIGS. 4*a* and 4*b* present a top view of the possible attitudes of the first and second rope pulley or rope pulley stack.

FIG. 3 presents as a schematic drawing how the roping R or C arrives (e.g. in the elevator arrangement according to FIG. 1-2) at the first and the second rope pulley/rope pulley stack 5*a*, 5*b*; 5*a*', 5*b*' from the aforementioned rope pulley or rope pulley stack 4; 4' close to each other onto the first and the second rope pulleys/rope pulley stacks 5*a*, 5*b*; 5*a*', 5*b*' of the elevator unit. The first and the second rope pulleys/rope pulley stacks 5*a*, 5*b*; 5*a*', 5*b*' are arranged to guide the first and the second part a, b; a', b' of the roping R, C arriving at them to be conducted away from each other, in which case the first and the second part a, b; a', b' travel away from the first and the second rope pulleys/rope pulley stacks 5*a*, 5*b*; 5*a*', 5*b*' of the elevator unit at a distance from each other. The first and the second part are guided to travel from the rope pulley 4, 4' between the aforementioned first and second rope pulleys/rope pulley stacks 5*a*, 5*b*; 5*a*', 5*b*', into a space between the rim surfaces of the rope pulleys, into the gap forming there, and to meet each of their rope pulleys between the aforementioned axes of rotation $X_1$, $X_2$. The first and the second part a, b; a', b' travel between the axes of rotation $X_1$, $X_2$, which are disposed non-coaxially, and bend in different directions, rising up on opposite sides of the axes of rotation $X_1$, $X_2$. From the viewpoint of improved efficiency in vertical space usage, it is advantageous that the axes of the aforementioned first and second rope pulley/rope pulley stacks 5*a*, 5*b*; 5*a*', 5*b*' are at essentially the same height. As presented in FIG. 4*a*, the axes of the aforementioned first and second rope pulley/rope pulley stacks 5*a*, 5*b*; 5*a*', 5*b*' are can be parallel, in which case an advantage is a symmetrical, simple and compact structure. Advantages relating to centricity of the supporting can, however, be achieved even if there were to be a slight angle between the axes of the rope pulleys/rope pulley stacks (as shown in FIG.

4*b*), in which case, however, preferably the angle between the axes of the aforementioned rope pulleys/rope pulley stacks that are disposed non-coaxially in relation to each other is at the most 45 degrees.

The supporting structure 3 is movable, i.e. the elevator arrangement (most preferably the supporting structure 3 itself, as is presented in the figures) comprises support means for the vertical support of the supporting structure 3 in its position in the elevator hoistway S, which means can be moved between a state supporting the supporting structure 3 in its position in the vertical direction and a state not supporting it in its position in the vertical direction. In the aforementioned state not supporting it in position the means do not hamper the vertical displacement of the supporting structure 3 in the hoistway. The support means can be implemented in many different ways, e.g. in some manner according to prior art. As presented in FIG. 2, the means in question can comprise support means 8 movable between an extended and retracted position in the lateral direction. The support means 8 support the supporting structure 3 in its position in the supporting state (in the vertical direction) resting on some other structure installed in the elevator hoistway or on a structure of the elevator hoistway itself. Alternatively, the support means can be such that in the position supporting the supporting structure 3 in its position they rest (in the vertical direction) supported by the guide rails intended for guiding the movement of the elevator unit, such as of the elevator car and/or counterweight, that are comprised in the elevator. Thus after the lifting of the supporting structure 3, the supporting structure 3 can be arranged to be supported in its position in the elevator hoistway S by locking it to be supported in the vertical direction by the guide rails. In this case the support means can be e.g. grippers to be manually tightened to the guide rails, or otherwise wedge clamps wedging automatically onto the guide rails. The support means 8 can be supported on the frame 10 of the supporting structure 3.

For enabling a jump lift, the elevator arrangement comprises means (not presented) for lifting the supporting structure upwards in the elevator hoistway. These means preferably comprise a movable support structure in the elevator hoistway, said structure to be supported in the elevator hoistway in the manner described above. The aforementioned means for lifting the supporting structure 3 upwards in the elevator hoistway are preferably such that they are arranged to pull the supporting structure higher up in the elevator hoistway from above, preferably via a flexible member such as a rope, chain or belt.

In the method according to the invention in the fabrication of an elevator an elevator arrangement is formed, in which the rope pulleys or rope pulley stacks of at least one elevator unit divide the roping R and/or C in the manner presented above, and in the method these phases are performed a) the elevator car is used to transport passengers and/or freight, after which
b) the supporting structure 3 is lifted to a higher position in the elevator hoistway S, after which
c) the elevator car is used to transport passengers and/or freight.

Thus the service range of the elevator car 1 is changed in steps to reach higher up in the elevator hoistway. After phase b has been performed one or more times, e.g. when a phase cycle comprising the aforementioned phases a, b and c has been performed one or more times, the suspension of the aforementioned elevator unit/elevator units, in connection with which are the aforementioned non-coaxial rope pulleys, is changed in such a way that the lifting ratio of the elevator unit (1 or 2) in question or of both the elevator units 1, 2 in question is 1:1. In this case new roping can be installed to replace the roping R in question or otherwise the roping R can be truncated near the elevator unit. In the change of suspension, the roping is fixed by its end to the elevator unit for achieving 1:1 suspension. Corresponding procedures can be performed for the compensating roping C. Rope for the lifting of phase b is released from the rope storage 20; 20', to which the roping R; C travels via an openable rope anchorage arrangement (6*a*, 6*b*; 6*a*', 6*b*'). Such a change in the lifting ratio is not, however, necessary. It is advantageous to implement the change in the lifting ratio in possible compensating ropes C in a corresponding manner.

Figure 5A:
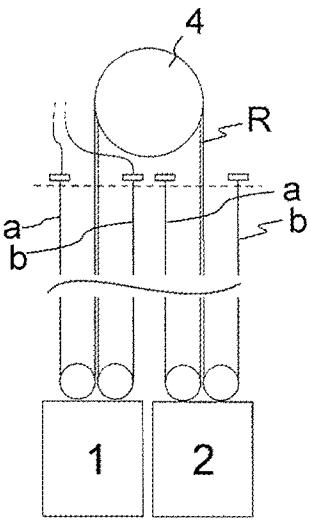
FIG. 5*a* presents a basic diagram of the suspension of the elevator of FIG. 1.
Figure 5B:
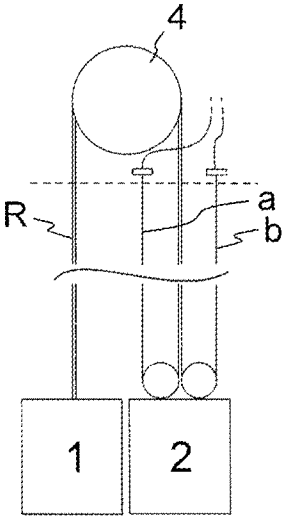
FIG. 5*b* presents an embodiment wherein only one of the elevator units is suspended via the first and second rope pulley or rope pulley stack.
Figure 5C:
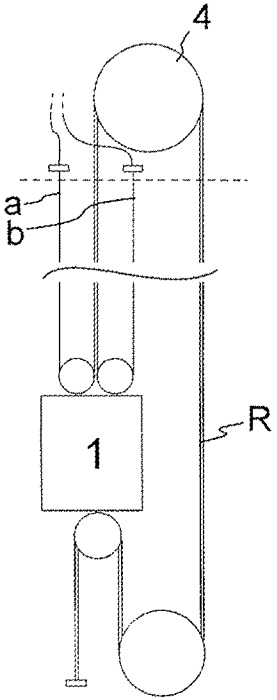
FIG. 5*c* presents an embodiment, in which the elevator is one without a counterweight.
Figure 6A:
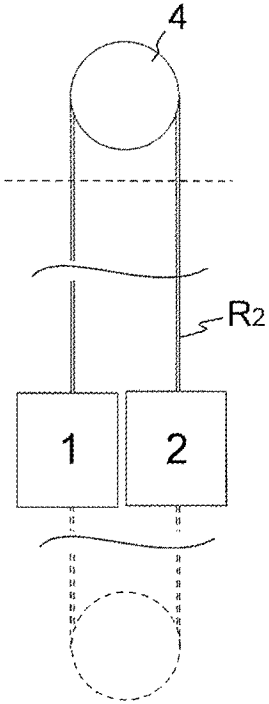
FIG. 6*a* presents an elevator with counterweight, after a change in the suspension ratio.
Figure 6B:
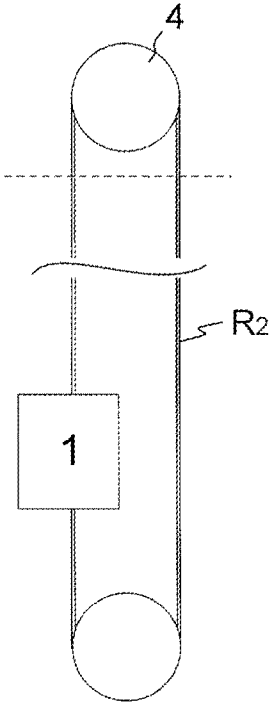
FIG. 6*b* presents an elevator without counterweight, after a change in the suspension ratio.

Distribution of the rope bundle on a side of both elevator units can be utilized for achieving more centric distribution, as is presented in connection with the embodiment of FIG. 1. A simplification of the principle is also presented in FIG. 5*a*. Distribution of the rope bundle can, however, be utilized in respect of only one of the elevator units, as is presented in FIGS. 5*b* and 5*c*. Distribution of the rope bundle can also be utilized in the case of an elevator without counterweight, as is illustrated in FIG. 5*c*. FIG. 6*a* presents what the elevator arrangement is like when the suspension ratio of any of the elevators with counterweight in FIGS. 1, 2, 5*a*, 5*b* is changed to possess a 1:1 suspension ratio. FIG. 6*b* presents what the elevator arrangement is like when elevator without counterweight presented in FIG. 5*c* is changed to possess a 1:1 suspension ratio. In this case e.g. the suspension of the elevator unit/elevator units can be changed by replacing the roping R with new roping $R_2$.

The aforementioned ropes of the roping R; C can be e.g. round in cross-sectional shape or can be other than round in cross-sectional shape. For example, they can be metal ropes or belts according to prior art. The elevator arrangement preferably forms the final elevator arrangement of the building as a conclusion of the method. The elevator arrangement is preferably inside a building, e.g. inside a high-rise building. Its lifting height is preferably in the final phase of the method over 100 meters, possibly considerably more, such as over 200 meters or even over 400 meters.

It is obvious to the person skilled in the art that in developing the technology the basic concept of the invention can be implemented in many different ways. The invention and the embodiments of it are not therefore limited to the examples described above, but instead they may be varied within the scope of the claims.

The invention claimed is:

1. A kit to construct an elevator arrangement, the kit comprising:

roping selectively connected to one or more elevator units, the roping including at least a first roping arrangement and a second roping arrangement;

a movable supporting structure in an elevator hoistway for supporting the one or more elevator units via the first roping arrangement during construction of the elevator arrangement;

a traction sheave attached to the movable supporting structure, the traction sheave configured to have the roping travel therearound and down to one or more of the elevator units; and a first pair of rope pulleys on one of the one or more elevator units, the first pair of rope pulleys including a first rope pulley and a second rope pulley disposed non-coaxially in relation to each other such that rotation axes of the first pair of rope pulleys are separate from each other in a lateral direction, wherein the kit is constructible such that, during construction of the elevator arrangement, the traction sheave is at a first horizontal position with respect to walls of the elevator hoistway, the first roping arrangement is in a 2:1 configuration, and a first rope of the first roping arrangement is configured to travel from the traction sheave to the first rope pulley under the first rope pulley and onwards back up to one or more rope anchors and a second rope of the first roping arrangement is configured to travel from the traction sheave to the second rope pulley under the second rope pulley and onwards back up to one or more of the rope anchors such that the first roping arrangement travels at a center point of a vertical projection of the one of the one or more elevator units, and after completion of the elevator arrangement, the first roping arrangement is swapped for the second roping arrangement, the second roping arrangement is in a 1:1 configuration, and the second roping arrangement is configured to travel from the traction sheave and terminate on the one or more elevator units at the center point such that a position of the traction sheave connected to the second roping arrangement remains at the first horizontal position after construction of the elevator arrangement and conversion from the 2:1 configuration to the 1:1 configuration.

2. The kit to construct the elevator arrangement according to claim 1, further comprising:

the one or more elevator units configured to move in the elevator hoistway, the one or more elevator units including a first elevator unit and a second elevator unit connected by the roping, the first elevator unit being an elevator car and the second elevator unit being a counterweight wherein, the roping on a first side of the traction sheave is configured to travel down to the first pair of rope pulleys on the elevator car, and the roping on a second side of the traction sheave is configured to travel down to a second pair of rope pulleys on the counterweight.

3. The kit to construct the elevator arrangement according to claim 2, wherein the counterweight is configured to travel on one side of the elevator car, and an axis of rotation of the traction sheave is parallel to a direction of a wall of the elevator car that is on the side of the counterweight.

4. The kit to construct the elevator arrangement according to claim 1, wherein the roping travels from the movable supporting structure down to the one or more elevator units such that the roping travels at the center point of the vertical projection of respective ones of the one or more elevator units.

5. A kit to construct an elevator arrangement, the kit comprising:

a movable supporting structure in an elevator hoistway, the movable supporting structure configured to support one or more elevator units during construction of the elevator arrangement;

roping selectively connected to the one or more elevator units and hanging suspended from the one or more elevator units, the roping including at least a first roping arrangement and a second roping arrangement;

a traction sheave configured to rotate below the one or more elevator units, the traction sheave configured to have the roping travel therearound and up to the one or more elevator units; and a first pair of rope pulleys including a first rope pulley and a second rope pulley disposed non-coaxially in relation to each other such that rotation axes of the first pair of rope pulleys are separate from each other in a lateral direction, wherein the kit is constructible such that, during construction of the elevator arrangement, the traction sheave is at a first horizontal position with respect to walls of the elevator hoistway, the first roping arrangement is in a 2:1 configuration, and a first rope of the first roping arrangement is configured to travel from the traction sheave to the first rope pulley over the first rope pulley and onwards back down to a rope anchorage arrangement and a second rope of the first roping arrangement is configured to travel from the traction sheave to the second rope pulley over the second rope pulley and onwards back down to one or more of the rope anchors such that the first roping arrangement travels at a center point of a vertical projection of the one of the one or more elevator units, and after completion of the elevator arrangement, the first roping arrangement is swapped for the second roping arrangement, the second roping is in a 1:1 configuration, and the second roping is configured to travel from the traction sheave and terminate on the one or more elevator units at the center point such that a position of the traction sheave connected to the second roping arrangement remains at the first horizontal position after construction of the elevator arrangement and conversion from the 2:1 configuration to the 1:1 configuration.

6. The kit to construct the elevator arrangement according to claim 5, wherein the roping travels as a dense bundle from the traction sheave to the first rope pulley and the second rope pulley, and the first rope pulley and the second rope pulley are configured to divide the first rope and the second rope of the first roping arrangement respectively, such that the first rope is conducted away from the second rope.

7. The kit to construct the elevator arrangement according to claim 6, wherein the first rope pulley and the second rope pulley are configured to guide the first rope and the second rope of the first roping arrangement respectively, such that the first rope and the second rope travel relatively close to each other from the traction sheave to the first pair of rope pulleys, and the first rope and the second rope travel relatively far from each other from the first pair of rope pulleys to one or more of the rope anchors.

8. The kit to construct the elevator arrangement according to claim 6, wherein the roping includes excess roping wound around a rope reel associated with a roping supply storage space, and the rope anchors are configured to open to adjust an amount of the excess roping wound around the rope reel.

9. The kit to construct the elevator arrangement according to claim 6, wherein the one or more elevator units include a first elevator unit and a second elevator unit connected by the roping, the first elevator unit being an elevator car and the second elevator unit being a counterweight, and the roping runs from the first pair of rope pulleys associated with the elevator car around the traction sheave and to a second pair of rope pulleys associated with the counterweight.

10. The kit to construct the elevator arrangement according to claim 6, wherein the movable supporting structure is liftable upwards in the elevator hoistway.

11. The kit to construct the elevator arrangement according to claim 6, wherein the first rope and the second rope of the first roping arrangement are guided to travel as a bundle from the traction sheave up between the first rope pulley and the second rope pulley.

12. The kit to construct the elevator arrangement according to claim 6, wherein axes of the first rope pulley and the second rope pulley are at an angle of less than or equal to 45 degrees with respect to each other.

13. A method of fabricating an elevator using an elevator arrangement including roping selectively connected to one or more elevator units, the roping including at least a first roping arrangement and a second roping arrangement, a movable supporting structure in an elevator hoistway for supporting the one or more elevator units via the first roping arrangement, a traction sheave configured to have the roping travel therearound and to one or more of the elevator units, and a first pair of rope pulleys including a first rope pulley and a second rope pulley disposed non-coaxially in relation to each other such that rotation axes of the first pair of rope pulleys are separate from each other in a lateral direction, the method comprising:

configuring, during construction of the elevator arrangement, the traction sheave at a first horizontal position with respect to walls of the elevator hoistway, the first roping arrangement being in a 2:1 configuration, and a first rope of the first roping arrangement travels from the traction sheave to the first rope pulley, under the first rope pulley and onwards back up to one or more rope anchors, and a second rope of the first roping arrangement travels from the traction sheave to the second rope pulley, under the second rope pulley and onwards back up to one or more of the rope anchors, transporting passengers and/or freight using one or more of the elevator units;

lifting the movable supporting structure to a higher position in the elevator hoistway;

re-enabling the elevator unit to transport the passengers and/or the freight; and changing a suspension of the one or more elevator units after completion of the elevator arrangement such that a lifting ratio of the one or more elevators units becomes a 1:1 configuration by reconfiguring the roping by swapping the first roping arrangement for the second roping arrangement such that the second roping arrangement travels from the traction sheave and terminates on the one or more elevator units at the center point such that a position of the traction sheave connected to the second roping arrangement remains at the first horizontal position after construction of the elevator arrangement and conversion from the 2:1 configuration to the 1:1 configuration.

14. The method according to claim 13, further comprising:

opening the rope anchors to adjust an amount of excess roping wound around a rope reel after lifting the movable supporting structure.

* * * * *